US006959815B2

(12) United States Patent
Xu et al.

(10) Patent No.: US 6,959,815 B2
(45) Date of Patent: Nov. 1, 2005

(54) SELECTIVE REACTIVE OILY BUBBLE CARRIERS IN FLOTATION PROCESSES AND METHODS OF GENERATION AND USES THEREOF

(75) Inventors: Zhenghe Xu, Edmonton (CA); Jianjun Liu, Edmonton (CA); Zhiang Zhou, Edmonton (CA)

(73) Assignee: The Governors of The University of Alberta, Edmonton (CA)

( * ) Notice: Subject to any disclaimer, the term of this patent is extended or adjusted under 35 U.S.C. 154(b) by 47 days.

(21) Appl. No.: 10/348,325

(22) Filed: Jan. 22, 2003

(65) Prior Publication Data

US 2003/0217953 A1 Nov. 27, 2003

Related U.S. Application Data

(60) Provisional application No. 60/351,371, filed on Jan. 28, 2002.

(51) Int. Cl.[7] ..... B03D 1/02; B03D 1/24

(52) U.S. Cl. ..... 209/166; 209/167; 209/170

(58) Field of Search ..... 209/166, 167, 209/170

(56) References Cited

U.S. PATENT DOCUMENTS

| | | | | |
|---|---|---|---|---|
| 1,246,665 A | * | 11/1917 | Scott | 209/166 |
| 1,354,031 A | * | 9/1920 | Dosenbach | 209/166 |
| 1,377,189 A | * | 5/1921 | Dosenbach | 209/167 |
| 1,400,308 A | * | 12/1921 | Moffat | 209/166 |
| 1,425,186 A | * | 8/1922 | Ridsdale | 209/166 |
| 1,508,478 A | * | 9/1924 | Scott | 209/166 |
| 3,506,120 A | * | 4/1970 | Kohno et al. | 209/166 |
| 4,203,837 A | * | 5/1980 | Hoge et al. | 210/705 |
| 4,859,318 A | | 8/1989 | Brookes et al. | |
| 5,443,158 A | | 8/1995 | McKenny et al. | |
| 5,507,394 A | | 4/1996 | Laskowski et al. | |
| 5,510,044 A | | 4/1996 | Laskowski et al. | |
| 5,935,447 A | | 8/1999 | Febres et al. | |

FOREIGN PATENT DOCUMENTS

| | | |
|---|---|---|
| CN | 1115264 | 1/1996 |
| GB | 2012621 | 8/1979 |
| WO | WO-9725149 | 7/1997 |
| WO | WO-0009268 | 2/2000 |

OTHER PUBLICATIONS

Fuerstenau, D.W., Fine Particle Flotation, In: Fine Particle Processing, Ed. P. Somasundaran, The Society of AIME, New York, NY, USA, 1980, 669–705.

Fuerstenau. D. W., Metzger, P. H. and Seele. G. D., How to Use This Modified Hallimond Tube . . . For Better Flotation Testing, Eng. Min. J., 1957, 158, 93–95.

Kent, W. and Ralston, J., Polymer–Stabilized Emulsions and Fine–Particle Recovery, II. The Chalcopyrite–Quartz System, International Journal of Mineral Processing, 1985, 14, 217–232.

Fuerstenau, M.C. Chemistry of Collectors in Solution, In: Principles of Flotation, Ed. King, R. P., South Africa Institute of Mining and Metallurgy, Johannesburg, 1982, 1–16.

Kusaka, E., Kamata, Y., Fukunaka, Y., Nakahiro, Y., The Role of Hydrolyzed Metal Cations in the Liquid–Liquid Extraction of Ultrafine Silica with Dodecyl Sulfate, Minerals Engineering, 1997, 10, 155–162.

(Continued)

*Primary Examiner*—Thomas M. Lithgow
(74) *Attorney, Agent, or Firm*—Bereskin & Parr; Patricia Power

(57) ABSTRACT

The present invention provides for a reactive oily bubble carrier comprising: (a) a gas bubble having an oil-coating; and (b) a collector dissolved within the oil-coating. The present invention also provides for the use a reactive oily bubble carrier in a flotation target particle separation process. The present invention also provides for a flotation target particle separation process using the reactive oily bubble carriers disclosed herein.

24 Claims, 14 Drawing Sheets

OTHER PUBLICATIONS

Kusaka, E., Nakahiro, Y., Wakamatsu,T., The Role of Zeta–Potentials of Oil Droplets and Quartz Particles during Collectorless Liquid–Liquid Extraction, International Journal of Mineral Processing, 1994, 41, 257–269.

Laskowski, J.S., Oil Assisted Fine Particle Processing, In: Colloid Chemistry in Mineral Processing, Eds. J. S. Laskowski, and J.Ralston, Elsevier Science Publishers, New York, NY, USA, 1992, 361–394.

Laskowski, J.S., Weak Electrolyte Collectors, In: Advances in Flotation Technology, Eds. B. K. Parekh, and J.D.Miller, The TSM Inc., Colorado, USA, 1999, 59–82.

Laskowski, J. S., Vurdela, R.M., and Liu, Q., The Colloid Chemistry of Weak Electrolyte Type Collector Fotation, In: Proceedings of XVI International Mineral Processing Congress, ed. K.S.E. Forssberg, 1988, Elseiver Science Publishers, New York, NY, USA, 703–715.

Liu, J., Zhou, Z. and Xu, Z., Electrokinetic Study of Hexane Droplets in Surfactant Solutions and Process Water of Bitumen Extraction Systems, Industrial Engineering of Chemistry, 2002, 41, 52–57.

Liu, J., Zhou, Z, Xu, Z. and Masilyah, J., Bitumen–Clay Interactions in Aqueous Media Studied by Zeta Potential Distribution Measurement, J. Colloid Interf. Sci., 2002, 252, 409–418.

Ralston, J., Kent, W. and Newcombe, G., Polymer–Stabilized Emulsions and Fine–Particle Recovery, I. The Calcite–Quartz System, International Journal of Mineral Processing, 1984, 13, 167–186.

Raph, W., Lal, M. and Fuerstenau, D.W., Liquid–Liquid Extraction of Ultrafine Particles, Transactions of AIME, 1968, 241, 549–556.

Shen, M. and Wheelock, T.D., Development and Scale–up of a Gas–Promoted Oil Agglomeration Process for Coal Beneficiation, Minerals & Metal. Processing, May 2001, 18, 87–94.

Sivamohan, R., The Problem of Recovering Very Fine Particles in Mineral Processing—A Review, International Journal of Mineral Processing, 1990, 26, 247–288.

Stratton–Crawley, R. Oil Floatation: Two Liquid Floatation Techniques In: Beneficiation of Mineral Fines, Eds. Somasundaran, P. and Arbiter, N., AIME, New York, N.Y., 1979, 316–340.

Taggart, A. F., Handbook of Ore Dressing, John Wiley & Sons, New York, 1927, 945 p. 786–791.

Wills, B., Mineral Processing Technology, 6th ed., (Butterworths 1998), p. 14.

Xu, M., Quinn, P. and Stratton–Crawly, R., A Feed–Line Aerated Flotation Column Part 1: Batch and Continuous Testwork, Minerals Engineering, 1996, 9, 499–507.

Yoon, R. –H., Microbubble Flotation, Minerals Engineering, 1993, 6, 619–630.

Zambrana, G.Z., Medina, R.T., Gutierrez, G.B. and Vargas, R.R., Recovery of Minus Ten Micron Cassiterite by Liquid–Liquid Extraction, International Journal of Mineral Processing, 1974, 1, 335–345.

Zhou, Z. A, Xu, Z., Finch, J. A., Hu, H. and Rao, S. R., Role of Hydrodynamic Cavitation in Fine Particle Flotation, Inter. J. Miner. Process. 1997, 51, 139–149.

Zhou, Z.A., Hussein, H., Xu, Z., Czarnecki, J. and Masilyah, J.H., Interaction of Ionic Species and Fine Solids with Low Energy Hydrophobic Surface from Contact Angle Measurement, Journal of Colloid and Interface Science, 1998, 204, 342–349.

Gomez, C.O., Acuña, C., Finch, J.A., and Pelton, R., Aerosol–Enhanced Flotation Deinking of Recycled Paper—Silicon Oil Offers an Effective Way of Forming a Layer on the Bubble Surface, Pulp & Paper Canada, 2001, 102, 28–30.

Maiolo, J. and Pelton, R., Aerosol–Enhanced Flotation—A Possible Approach to Improved Flotation Deinking, J. Pulp and Paper Science, 1998, 24, 324–328.

The Role of Caviation In Coal Flotation, M. Attalla, C. Chao and Nicol S.K.; *Paper H3*, p. 337–350.

Coal Agglomeration With Microbubbles, M. Shen and T.D. Wheelock, *Coal Preparation*, vol. 21, pp. 277–298, 2000.

Development and Scale–up of a Gas–Promoted Oll Agglomeration Process for Coal Beneficiation, M. Shen and T.D. Wheelock, *Minerals & Metallurgical Processing*, Vo., 18, No. 2, May 2001.

* cited by examiner

SELECTIVE REACTIVE OILY BUBBLE CARRIERS IN FLOTATION PROCESSES AND METHODS OF GENERATION AND USES THEREOF

RELATED APPLICATIONS

This application claims the benefit and priority from U.S. Provisional Patent Application No. 60/351,371 filed Jan. 28, 2002, entitled, "Selective Reactive Oily Bubble Carriers in Flotation Processes and Methods of Generation and Uses Thereof", the entirety of which is incorporated herein by reference.

FIELD OF THE INVENTION

The present invention relates to the field of flotation processes, and more particularly relates to the generation of reactive oily bubble carriers and their use in flotation processes.

BACKGROUND OF THE INVENTION

Air bubble flotation processes are widely used for particle separation and recovery in the minerals, coal, oil sands, and pulp and paper industries. However, conventional air bubble flotation systems are ill equipped to efficiently and economically separate and recover fine particles with diameters of <10 μm. This is due in part to the differences in the associated physiochemical and hydrodynamic conditions that exist in fine particle flotation systems. More specifically, fine particles have small masses and low inertia. As such, the fine particles tend to become entrained in the liquid streamlines that flow around the rising air bubbles, resulting in a low collision efficiency of the fine particles with the flotation air bubbles. Even after contacting the air bubbles, the fine particles may not have sufficient kinetic energy to rupture the intervening liquid films between the particle and the air bubble, which is required to achieve three-phase contact. The resultant retardation of three phase contact formation further contributes to a low attachment efficiency (Ralston, et al., 1984, Kent and Ralston, 1985).

To improve collision efficiency, the use of microbubbles as flotation carriers was developed and implemented (Yoon, 1993). However, fine particle flotation systems need an excessively large amount of small and stable air bubbles in order to provide sufficient bubble surface area flux for the required carrying capacity. Recently, hydrodynamic cavitation (Zhou, et al., 1997) incorporated into feed aeration (Xu, et al., 1996) was proposed for improving fine particle flotation, and resulted in the development of picobubble technology for fine coal flotation (Hart, 2001). As in microbubble flotation, the use of picobubbles (<100 μm) as carriers in fine particle flotation systems often results in a higher water recovery, and hence an increased mechanical entrainment of fine gangue particles. This results in a poor separation efficiency (grade of target particles).

Oil flotation (or liquid-liquid extraction) was proposed and showed great potential for improving fine particle recovery (Ralph, et al., 1968, Zambrana, et al., 1974). In this technology, oil droplets, instead of air bubbles, were used as carriers for hydrophobic particle flotation. Small, stable oil droplets can be produced by emulsification techniques, and their diameters can be varied from about 0.5 μm to about 50 μm (Ralston, et al., 1984; Kent and Ralston, 1985). Generating oil droplets in this size range is much more feasible than generating air bubbles of similar sizes. Moreover, since an oil droplet has a higher inertia than an air bubble under the same physical and hydrodynamic conditions, the collision efficiency of the fine particles with the oil droplets tends to be higher than with similarly sized air bubbles. Additionally, fine particles are more easily collected at an oil-water interface than at an air-water interface (Fuerstenau, 1980). This is due mainly to stronger spreading potency enhanced by a stronger long-range attractive molecular force between oil and solid than between air and solid interfaces. The use of oil droplets as flotation carriers can also minimize the water recovery, as the spreading nature of oil on solids displaces the otherwise retained process water which collects around air bubbles and the solids.

The feasibility of oil droplet flotation has been demonstrated at laboratory scale for recovering particles less than 10 μm (Kusaka, et al., 1994, 1997). However, direct application of oil droplet flotation to fine particle flotation at a commercial scale was considered uneconomical, due to the large amount of oil needed for operation. This is one of the reasons why the earliest flotation processes, known as Haynes, Everson and Cattermole processes (Fuerstenau, 1980), which used bulk oil as the carrier for hydrophobic particle flotation was not applied on a commercial scale. As in conventional flotation with air bubbles as carriers, in flotation systems with oil droplets as carriers, the collector was added to the aqueous phase. Thus, a large quantity of the collector was required for this process. Moreover, the presence of collector on mineral surfaces and at oil-water interfaces retarded the attachment process of the particle with the oil droplets due to a lack of direct contact between the two.

More recently, employed in coal cleaning are oily droplet carriers that have oil-soluble collectors dissolved therein. This is referred to as emulsion flotation and is accomplished by emulsifying collector-containing in the oil phase (e.g. kerosene) with the addition of promoters in the oily collector phase to enhance the dispersion of oily collectors (Laskowski, 1992). Emulsification of an oily collector increases the number of oil droplet carriers, and therefore aids in the flotation kinetics of the system. The addition of promoters also reduces the oil/water interfacial tension, leading to improved spreading of collector-containing oil droplets on target particle surfaces. The objective of using oil in this case is to enhance collector distribution in the pulp. The increased flotation recovery by the emulsified oil droplets has been reported (Laskowski, 1992). However, since a large quantity of oil is needed in this process to form the oil droplets, a corresponding large amount of collector is required for dissolution into the oil droplet. Unfortunately, this encourages the transfer of collector from the oil droplet to the aqueous medium. As described above, in addition to a large amount of oil and collector required for this approach, the presence of collector on mineral surfaces and at oil-water interfaces of the oil droplets retards the attachment process of the mineral with the oil droplets due to a lack of direct contact between the two.

A technique of using air to promote oil agglomeration was developed (Shen and Wheelock, 2000, 2001) for fine coal cleaning, in an attempt to minimize the overall oil consumption and to enhance the coal cleaning. In this process, a small amount of air (entrained, added or supersaturated) was introduced into the coal slurry with added hydrocarbon oil under high shear conditions. Tiny air bubbles were formed by gas nucleation and cavitation in the slurry. Based on the original model suggested by Taggart (1927), an oil film would spread on the bubbles, and as such the oil-coated bubbles could act as carriers for collecting hydrophobic coal particles to form compact gas/oil/coal agglomerates. Compared with the cases without air addition, the recovery and separation efficiency of fine coal was increased, while the amount of oil required for achieving the same efficiency was reduced, especially for moderately hydrophobic coal flotation. The possible application of oily bubbles to enhancing de-inking efficiency has been demonstrated recently (Finch, et al., 2001). However, in this process all of the process aids were added to the aqueous phase resulting in the same shortcomings noted above for the other two processes.

Accordingly, there remains a need for a particle flotation system that economically and efficiently achieves a high percentage of target particle separation and recovery.

SUMMARY OF THE INVENTION

The present invention provides a reactive oily bubble carrier that has advantages over the prior art especially in flotation methods for particle separation.

In one embodiment the invention provides a reactive oily bubble carrier that comprises a gas bubble comprising an oil-coating and a collector dissolved within the oil-coating. In a further embodiment, the collector dissolved in the oil-coating is in a concentration sufficient to enhance the affinity between the target particle and the reactive oily bubble carrier thereby promoting attachment of the target particle to the oil-coating.

In another embodiment, the invention provides a floatation separation method for separating a target particle from an aqueous phase, comprising introducing an amount of reactive oily bubble carrier into the aqueous phase sufficient to promote attachment of the target particle to the reactive oily bubble carrier to form an agglomerate. In one embodiment, the reactive oily bubble carrier is introduced into the aqueous phase in an amount and at a rate sufficient to promote attachment of the target particle to the reactive oily bubble carrier. The resulting agglomerate is separated from the aqueous phase and optionally recovered from the aqueous phase.

In yet another embodiment, the invention provides a system for separating a target particle from an aqueous phase comprising:

(a) a vesicle comprising an aqueous phase;

(b) a target particle in the aqueous phase;

(c) a reactive oily bubble carrier that has an affinity for attachment with the target particle;

(d) a means for introducing said reactive oily bubble carrier into said vesicle to enable said oily bubble carrier to pass through and/or circulate within said vesicle in a sufficient amount and at a sufficient rate to promote attachment to said target particle.

In one embodiment, dissolving a collector into the oil phase of a reactive oily bubble carrier can offer one or more of the following advantages over the prior art oil flotation carriers:

i) elimination of the addition of collectors to the aqueous phase, thereby minimizing the undesired activation of gangue particles;

ii) reduction in the actual amount of collector required by minimizing the distribution of collector molecules in the aqueous phase and their adsorption on undesirable solids;

iii) avoidance of unnecessary synergetic interaction between the collector, the frother and other chemical species that may be present in the slurry;

iv) achievement of a higher localized concentration of collector molecules at the oil/water interface, giving rise to a stronger collecting power;

v) only the targeted particles will be captured by the reactive oily bubbles through specific, chemical and/or electrochemical interactions of collector molecules at the oil/water interface with active sites on the target minerals, offering a better selectivity; and vi) stronger collecting power of reactive oily bubbles for both fine and coarse particles due to high potency of oily bubble attachment on target solid particles.

Other features and advantages of the present invention will become apparent from the following detailed description. However, it should be understood, that the detailed description and the specific examples while indicating preferred embodiments of the invention are given by way of illustration only, since various changes and modifications within the spirit and scope of the invention will become apparent to those skilled in the art from this detailed description.

BRIEF DESCRIPTION OF THE DRAWINGS

For a better understanding of the present invention, and to show more clearly how it may be carried into effect, reference will now be made, by way of example, to the accompanying drawings, which show a preferred embodiment of the present invention and in which.

and 0.25 v/v % MIBC dissolved therein on various mineral surfaces as a function of pH with the addition of $Na_2SiO3$ and $CuSO_4$ into the aqueous phase.

DETAILED DESCRIPTION OF THE INVENTION

Figure 1:
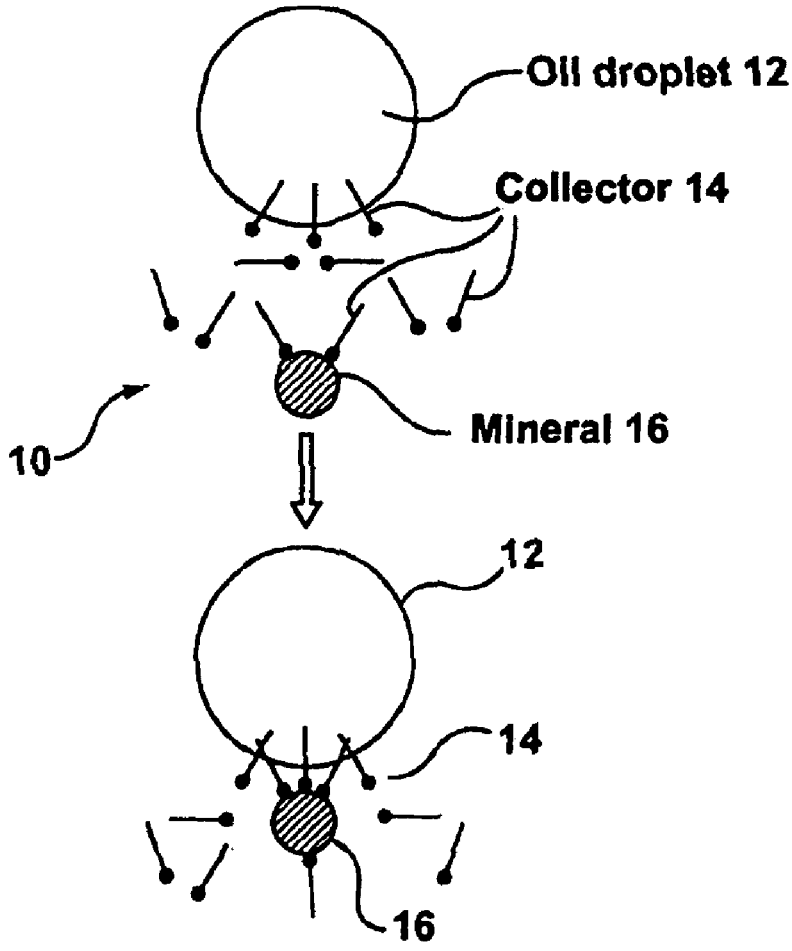
FIG. 1 (Prior Art)
FIG. 1 is a schematic diagram of a first prior art oil flotation carrier in an aqueous medium.

Referring first to FIG. 1, a schematic diagram of a first prior art oil flotation carrier system in an aqueous medium is shown generally at 10. The system 10 comprises an oil droplet 12, a collector located generally in the aqueous phase 14, and a mineral 16 to be collected. The arrow refers to the process of attachment of the mineral 16 onto the surface of the oil droplet 12. Since the collector 14 is added to the aqueous phase, a large quantity is required for this process. Moreover, the presence of the collector 14 on mineral surfaces 16 and at the oil-water interfaces of the oil droplets 12 retards the attachment process of the mineral 16 with the oil droplets 12 due to a lack of direct contact between the two.

Figure 2:
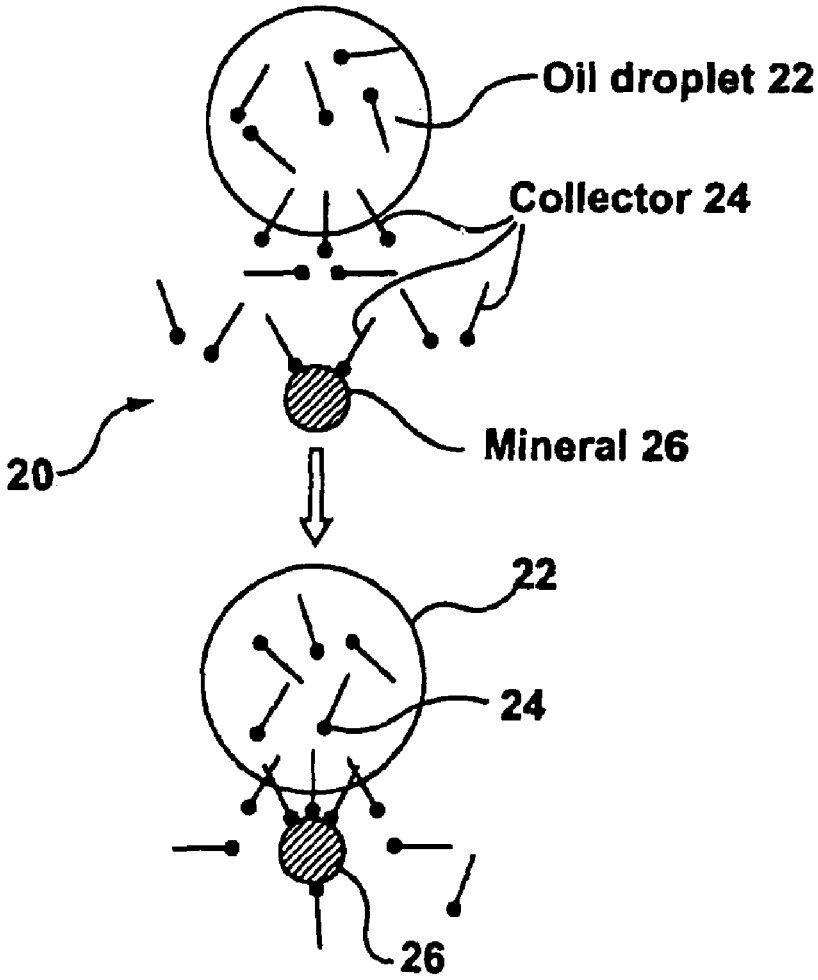
FIG. 2 (Prior Art)
FIG. 2 is a schematic diagram of a second prior art oil flotation carrier in an aqueous medium.

Referring now to FIG. 2, a schematic diagram of a second prior art oil flotation carrier system in an aqueous medium is shown generally at 20. This process is commonly referred to as emulsion flotation. The system 20 comprises an oil droplet 22, an oil-soluble and water-insoluble collector dissolved generally within the oil droplet 22, and a mineral 26 to be collected. Since a large quantity of oil is used to form the oil droplets 22, a corresponding large amount of collector 24 is required for dissolution into the oil droplet 22. This encourages the transfer of collector 24 from the oil droplet 22 into the aqueous medium. As described above, the presence of collector 24 on the mineral surfaces 26 and at the oil-water interfaces of the oil droplets 22 retards the attachment process of the mineral with the oil droplets 22 due to a lack of direct contact between the two.

Figure 3:
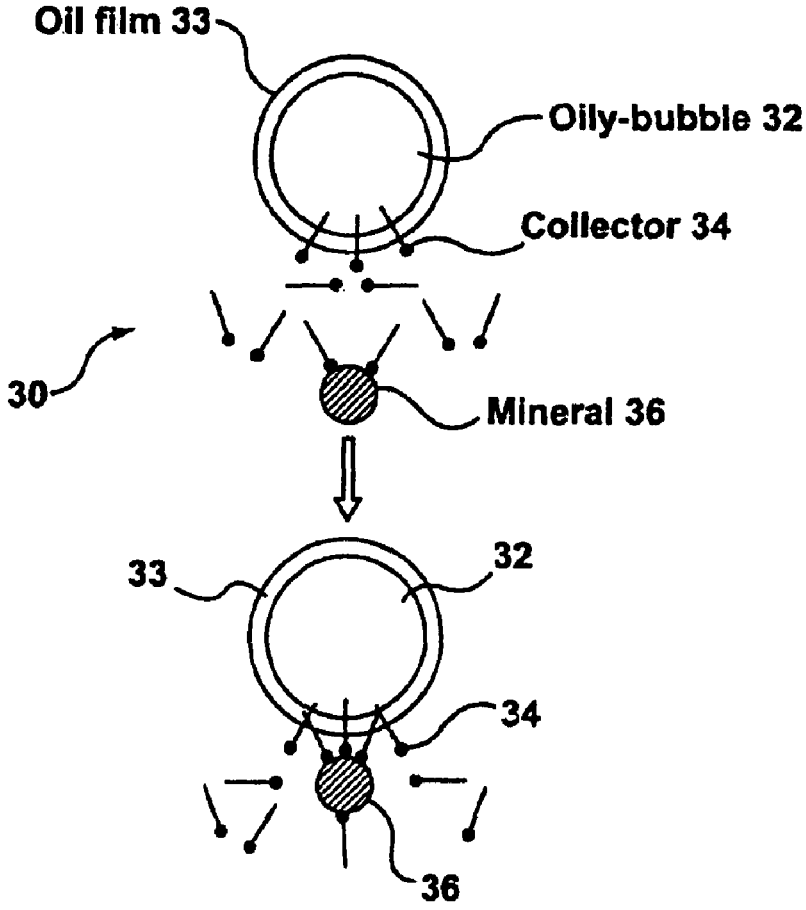
FIG. 3 (Prior Art)
FIG. 3 is a schematic diagram of a third prior art oil flotation carrier in an aqueous medium.

Referring now to FIG. 3, a schematic diagram of a third prior art oil flotation carrier system in an aqueous medium is shown generally at 30. The system 30 comprises a gas bubble 32 coated with an oil film 33, collector located generally in the aqueous phase 34, and a mineral 36 to be collected. This system is commonly referred to as oily-bubble flotation. This system suffers from the same disadvantages of the first and second prior art systems noted above, due to the fact that the collector 34 resides in the aqueous medium.

Figure 4:
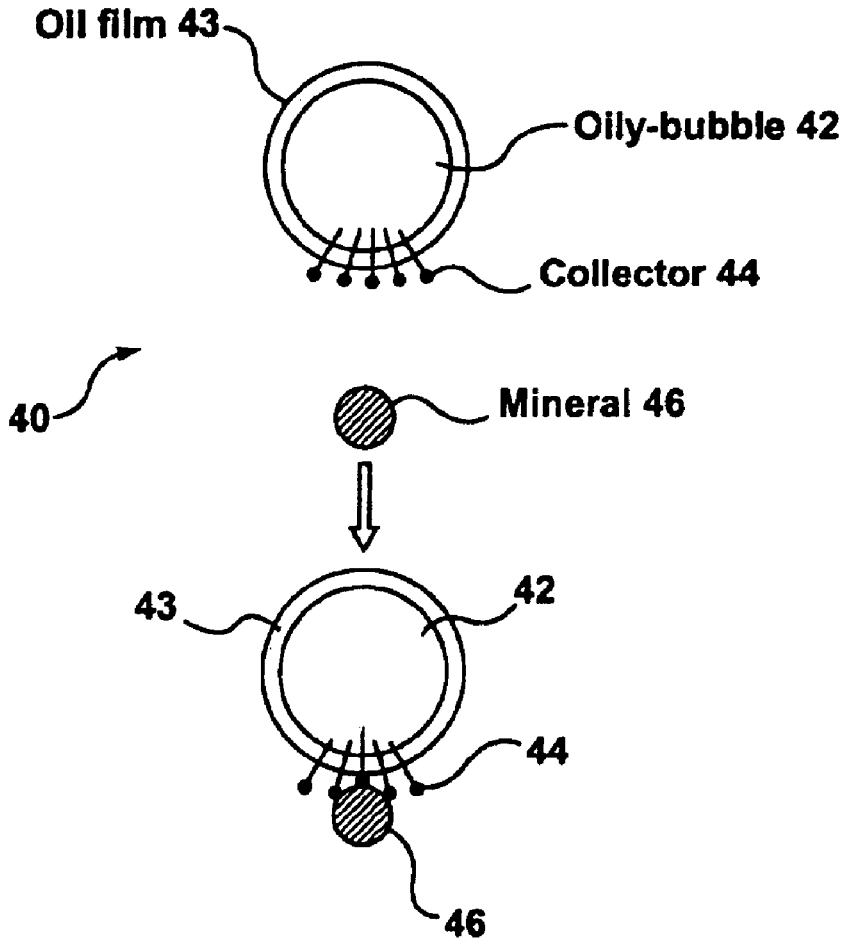
FIG. 4 is a schematic diagram of a reactive oily bubble (an oil-coated bubble carrier with collector dissolved therein) in an aqueous medium according to the present invention.

Referring now to FIG. 4, a reactive oily bubble carrier flotation system according to the present invention is shown generally at 40. The system 40 comprises a gas bubble 42 coated with an oil-coating 43, a collector 44 dissolved within the oil-coating 43 of the bubble 42, and a mineral 46 to be collected. The collector generally has a hydrophilic head that generally resides at the oil/water interface, and a hydrophobic tail that generally resides within the oil-coating. Without being bound by theory, the hydrophilic head of the collector has a selectivity and affinity for a target particle, and promotes attachment of the target particle onto the surface of the reactive oily bubble carrier. This is accomplished through one or more of the following processes: chemical adsorption/binding, electrochemical reaction, hydrogen bonding, and/or physical adsorption driven by opposite charges. The reactive oily bubble carrier allows for easy control of the oil/water interfacial chemistry by dissolving desired types and concentrations of collectors into the oil-coating. Accordingly, the electrokinetic and chemical properties of the reactive oily bubble carrier can be adjusted to enhance the selectivity and affinity for a target particle as required for a specific flotation system. The surface properties of the reactive oily bubble carrier can be readily assessed by zeta potential measurements and contact angle measurements, as will be described in more detail below. This information can be used to predict the suitability of a reactive oily bubble carrier to a particular flotation process.

In one embodiment, the reactive oily bubble carrier may comprise more than one type of collector, to enhance the affinity of the reactive oily bubble carrier to one or more target particle species.

In yet another embodiment, the reactive oily bubble carrier may attach to one or more desired target species. Said reactive oily bubble may contain one collector or more than one collector.

In another embodiment the more than type of reactive oily bubble carrier (e.g. comprising different collectors to enhance the affinity of the same or different target species), may be used in the process and system of the present invention.

In yet another embodiment, the gas within the bubble is air or nitrogen, however other suitable gases would be possible. In one embodiment such gases are stable gases that enable the bubble to float with respect to the aqueous phase. In yet another embodiment the gas bubble is of a suitable size. In one embodiment the gas bubble is about 100 microns to about 3 mM in diameter In one embodiment of the invention the collectors have a partition co-efficients of about 1000:1 to about 10,000:1 (reactive oily bubble carriers:aqueous phase). In yet another embodiment, the collectors are present in the oil-coating of the bubble in a concentration preferably between about 0.01 mM to about 100 mM, more preferably between about 0.05 mM to about 0.1 mM.

An "aqueous phase" as used herein means a phase with water as a continuous phase and can include a multiphase with water as a continuous phase for example but not limited to a mineral slurry.

An "oil" as used herein means an organic solvent. Examples of oils, include, but are not limited to, any light hydrocarbon having a relatively low viscosity (e.g., kerosene, diesel oil, waste engine oil, food oil).

An "oil droplet" as used herein means a small portion of oil. In one embodiment the droplet comprises about 100 microns to 1 mM of oil.

An "oily bubble carrier" as used herein means a gas bubble having a oil-coating enclosing the gas bubble. In one embodiment the oily bubble carrier comprises a thin oil-coating, for example, but not limited to about 10 NM to about 100 nM in thickness.

A "collector" as used herein is any molecule that can be dissolved in the oil-coating of a gas bubble and promote attachment to a target particle while so dissolved. The collector is adapted to modify the chemistry and/or electrokinetic properties of the oil/water interface. Examples of collectors include, but are not limited to the following classes of molecules: aliphatic acids and corresponding salts, aliphatic or aromatic xanthates, aliphatic hydroximate acids, and aliphatic amines. A person skilled in the art upon reading this description could select collectors suitable for the target particle in question. [King, 1982; Taggart, 1927;

Barry Wills: Mineral Processing Technology, 6th ed. Butterworths, 1998].

A "reactive oily bubble carrier" as used herein means a gas bubble having an oil-coating enclosing the gas bubble, and a collector dissolved within the oil-coating.

A "frother" as used herein is any molecule well known in the flotation art that can be dissolved in the oil phase and/or the aqueous phase to stabilize the reactive oily bubble carrier to affect the reactive oily bubble carrier surface area for target particle loading. Examples of frothers include, but are not limited to, methyl isobutyl carbinol (MIBC), pine oil, or DOW frothers.

An "activator" as used herein is any molecule well known in the flotation art that can be dissolved in the aqueous phase and promote attachment of a reactive oily bubble carrier with a target particle while so dissolved. Examples of activators include, but are not limited to, inorganic, divalent salts (e.g., copper sulphate), various weak acids (e.g., hydrogen sulfide, sodium meta-bisulfite, and hydrofluoric acid), and complex agents (e.g., diethylene triamines).

A "depressant" as used herein is any molecule well known in the flotation art that can be dissolved in the aqueous phase and depress attachment of a reactive oily bubble carrier to at least one non-target or unwanted particle. Examples of depressants include, but are not limited to, inorganic sodium silicate, sodium polyphosphates, sodium cyanide, organic and polymeric compounds (e.g., tannin, guar gum, starch, dextrins, polyacriliacids, polyacrylamides.)

A "target particle" as used herein is any particle that can selectively be attached to the surface of a reactive oily bubble carrier. Examples of target particles include, but are not limited to the following: (a) natural minerals recovered from mineral processing, such as, sphalerite (zinc sulphide or ZnS), galena (lead sulphide or PbS), chalcocite, chalcopyrite, pentlandite, arsenopyrite, pyrrhotite, pyrite, and various oxides (including iron oxides and cassiterite); (b) particles relating to potash processing, such as, sylvite and phosphate (fluoapatite) ores; (c) particles relating to the de-contamination of clays, such as iron oxide or titanium dioxide; (d) particles relating to the recycling of metals, for example, but not limited to silver or gold; (e) particles removed from wastewater, for example but not limited to arsenic, selenium, or aromatic organic contaminants.

A "target particle species" as used herein is one particular type of target particle or target particles.

A "non-target or unwanted particle" as used herein is any particle that remains behind in the aqueous phase after the flotation has occurred.

A "non-target or unwanted particle spiecies" as used herein is one particle type of non-target or unwanted particle or non-target or unwanted particles.

An "agglomerate" as used herein means a target particle attached onto the surface of a reactive oily bubble carrier.

Thus in one embodiment the invention provides a reactive oily bubble carrier, comprising: (a) a gas bubble having an oil-coating; and (b) a collector dissolved within the oil-coating.

In one embodiment the gas is air or nitrogen.

In another embodiment, the reactive oily bubble carrier is used in a flotation process for separation of a target particle in an aqueous phase, wherein the collector dissolved in the oil-coating is in a concentration sufficient to enhance the affinity between the target particle and the reactive oily bubble carrier thereby promoting attachment of the target particle to the oil-coating.

In yet another embodiment, the reactive oily bubble carrier further comprises a frother substantially dissolved within the oil-coating.

In yet another embodiment, the oil is substantially insoluble in the aqueous phase.

In yet another embodiment, the collector is a surfactant.

In yet another embodiment, the partition co-efficient of the collector is higher in the oil-coating than in the aqueous phase.

In another embodiment the collector is substantially soluble in the oil-coating and substantially insoluble in the aqueous phase.

In one embodiment, the aqueous phase further comprises an activator.

In another embodiment the aqueous phase further comprises a depressant.

In yet another embodiment the reactive oily bubble carrier comprises one or more collectors.

In another embodiment the collector promotes the attachment of one or more target particle species to the oil-coating.

In one embodiment the invention provides a flotation process for separation of a target particle, comprising: (a) providing an aqueous phase containing a target particle species; (b) introducing an amount of reactive oily bubble carrier according to the invention into the aqueous phase sufficient to promote attachment of the target particle to the reactive oily bubble carrier thereby forming an agglomerate that is separate or is separated from the aqueous phase; and (c) optionally recovering said agglomerate.

In another embodiment the invention provides a flotation separation system for separating a target particle from an aqueous phase comprising:

(a) a vesicle comprising an aqueous phase, said vesicle being any container, tube or other means that can comprise an aqueous phase;

(b) a target particle in the aqueous phase;

(c) a reactive oily bubble carrier that has an affinity for attachment with the target particle;

(d) a means for introducing said reactive oily bubble carrier into said vesicle to enable said oily bubble carrier to pass through and/or circulate within said vesicle in a sufficient amount and at a sufficient rate to promote attachment to said target particle. For instance, in one embodiment, the reactive oily bubble carrier is introduced at the bottom of the aqueous phase to enable it to float up and through the aqueous phase. In yet another embodiment a stir bar or other circulating device could be used for a sufficient period of time to disperse the oily bubble carrier through the aqueous phase to enable the oily bubble carrier to attach to a target particle. Other means would be known to a person skilled in the art upon reading the description.

In yet another embodiment, the flotation system further comprises a means for separating and/or recovering said target particle from said aqueous phase.

A person skilled in the art would understand that the design parameters of a reactive oily bubble carrier flotation system include, but are not limited to the following: the type of oil chosen, the type of collector chosen, the concentration of the collector chosen, the pH of the aqueous phase, the addition of a frother to the oil phase and/or the aqueous phase to increase the stability of the reactive oily bubble carriers; the addition of an activator to the aqueous phase to promote attachment of a reactive oily bubble carrier to a target particle, and addition of a depressant to the aqueous phase to depress attachment of the reactive oily bubble carrier to at least one non-target or unwanted particle species.

A person skilled in the art would understand that the selection of one or more collectors to be used in a process will depend on the chemical and/or electrokinetic surface properties desired for the reactive oily bubble carrier. These surface properties will be controlled to complement the characteristics of the desired target particle species to promote attachment of the target particles onto the surfaces of the reactive oily bubble carriers.

The zeta potential of a reactive oily bubble carrier is a measure of the degree of surface charge that the carrier exhibits. The addition of a collector to the oil-coating of a reactive oily bubble carrier can increase or decrease the surface charge of the carrier as desired. This can be used to promote attachment between the target particle and the reactive oily bubble carrier. For example, if the target particle is positively charged, the addition of a collector to the oil-coating of a reactive oily bubble carrier that will decrease the zeta potential or surface charge to render it more negative will promote attachment of the positively charged target particle onto the surface of the negatively charged reactive oily bubble carrier.

The contact angle between a reactively oily bubble carrier and a target particle is related to the affinity that the reactive oily bubble carrier has for the target particle. Thus, a high contact angle denotes a high affinity for the target particle. As such, a person skilled in the art may conduct routine tests to optimize the operating conditions (i.e., the pH range) to produce the greatest contact angle between the target particle and the reactive oily bubble carrier. Additionally, microflotation tests can be conducted for multiple particle systems to attempt to selectively separate and recover a target particle species from one or more different non-target particle species. As such, a person skilled in the art may conduct routine microflotation tests to optimize the selectivity and affinity of the reactive oily bubble carrier to the target particles.

The reactive oily bubble carrier flotation process in accordance with the present invention is considered attractive far both fine and coarse particle flotation. Reactive oily bubble carrier flotation processes may be applied to many different industries, including, but not limited to: mineral processing, potash processing, de-contamination of clay minerals, metal recovery from waste streams, de-toxification of industrial effluents and wastewater (e.g., pulp and paper wastewater treatment, and generally in any application where solvent extraction may be employed. [See Mineral Processing Handbook (SME Inc., Littleton Colo. (1985)].

Broadly speaking, the general know-how of choosing an appropriate collector or collectors for separation of a target particle species with a solvent extraction process can be applied to a reactive oily bubble flotation process. In both processes, the collector is added to the oil phase to modify the chemical and/or electrokinetic properties of the oil phase thereby promoting attachment of the target particle species to the oil phase to effect separation of the target particle species from the aqueous phase.

For sulphide mineral processing (e.g., separation of sphalerite, galena, chalcocite, chalcopyrite, pentlandite, arsenopyrite, pyrrhotite, or pyrite) the collectors can include, but are not limited to, thiol and xanthate families, thiophosphate and thiocarbamate families and phosphoric acid families (e.g., di(2-ethyle hexel) phosphoric acids). It is understood that the above collectors can be used either alone or in any suitable combination thereof.

For oxide mineral processing (e.g., separation of iron oxides and cassiterite), the collectors can include, but are not limited to, fatty acid families, amine families, and hydroxamate families. It is understood that the above collectors can be used either alone or in any suitable combination thereof.

For potash mineral processing (please provide examples of potash minerals), the collectors can include, but are not limited to, fatty acid families, and amine families. It is understood that the above collectors can be used either alone or in any suitable combination thereof.

To remove impurities from, such as iron—and/or titanium containing oxides, from an aqueous phase, the collectors can include, but are not limited to, fatty acid families, and hydroxamate families. It is understood that the above collectors can be used either alone or in any suitable combination thereof.

For metal recovery from waste streams, the collectors can include, but are not limited to, one or more water insoluble chelating agents well known in the solvent extraction art.

The invention will be more fully understood by reference to the following examples. However, the examples are merely intended to illustrate embodiments of the invention and are not to be construed to limit the scope of the invention.

EXAMPLES

Materials

Kerosene oil was purchased from Fisher. The collectors examined in the various tests included palmitic acid sodium salt (NaPa>99%, from Aldrich), palmitic acid (HPa>99%, from Aldrich), potassium dodecyl xanthate (KDX, custom-synthesized by Charles Tenant), dodecylamine (DDA>90%, from Aldrich), and dodecyl amino hydrochloride (DACI>99%, from Kodak). NaPa, Hpa, and KDX are all anionic surfactants, while DACI is a cationic surfactant.

Methyl isobutyl carbinol (MIBC) is a frother, copper sulfate ($CuSO_4*5H_2O$ analytical grade was purchased from BDH Canada) is an activator, and sodium silicate ($Na_2SiO_3*5H_2O$ technical grade was purchased from Fisher) is a depressant. Reagent grade HCl and NaOH were used for pH adjustments, and ultrahigh purity KCl (>99.999%) was used as a supporting electrolyte.

Silicon wafers of 100 crystal planes were purchased from MEMC electronic Materials in Italy for contact angle measurements. The mineral galena and sphalerite samples were purchased from Ward's Neutral Science Establishment (Canada). The fracture chunks of spalerite and galena minerals were used for contact angle measurement. All of the contact angle and microflotation experiments were carried out in de-ionized water with a resistivity of 18.2 MΩ cm, prepared with an Elix 5 followed by a Millipore ultra water purification system.

Experimental Procedures

Zeta Potential Measurements

To examine the activity of reactive oily bubble carriers, the electrokinetics of kerosene oil emulsions were measured. To simplify the measurement, kerosene oil droplets were substituted for the reactive oil bubble carriers. Additionally, to make reliable measurements and account for dynamic surfactant transfer mechanism in reactive oily bubble systems, the zeta potentials of kerosene oil droplets in collector (surfactant) solutions were measured.

The method of measuring the zeta potential of kerosene oil droplets in collector (surfactant) solutions is described in detail below. Oil droplets at approximately 0.2% by volume in collector (surfactant) solutions were prepared in an ultrasonic bath. The ultrasonication lasted for about 1–2 minutes in the presence of the collector (surfactant), and about 4–5 minutes in the absence of the collector (surfactant) to obtain oil droplets of an average size of about 1 μm. The zeta potential was measured with a Zetaphoremeter III (SEPHY/CAD), which consisted of a rectangular electrophoresis cell, a pair of hydrogenated Palladium electrodes, a laser-illumination and video (CCD camera)-viewing system. The computerized operating system allowed accurate position of view field at a stationary layer for electrophoretic mobility measurement. About 30 ml of the prepared oil droplet suspension was used to fill the electrophoresis cell. Through the laser-illuminating and video-viewing system, the movement of the droplets at stationary layer in the cell was traced, 5 times for each direction by alternating positive/negative electrode potentials. The captured images were then analyzed with the built-in software. The distribution histogram of electrophoretic mobility and corresponding average values were determined and converted to zeta potential values as desired. In this study, the environmental temperature was maintained at 22±0.1° C. Each test was repeated a few times and the average was reported. The measurement error was found to be better than ±5 mV.

Contact Angle Measurements

To examine the selective attachment of reactive oily bubbles on target mineral particles, the contact angles of reactive oily-bubbles on a solid samples (i.e. a silica wafer or mineral crystals) in water were measured using the technique described by Zhou, et al. (1998). A high contact angle for a specific target particle suggests a strong affinity of the reactive oily bubble for that target particle.

Figures 5A, 5B, 5C:
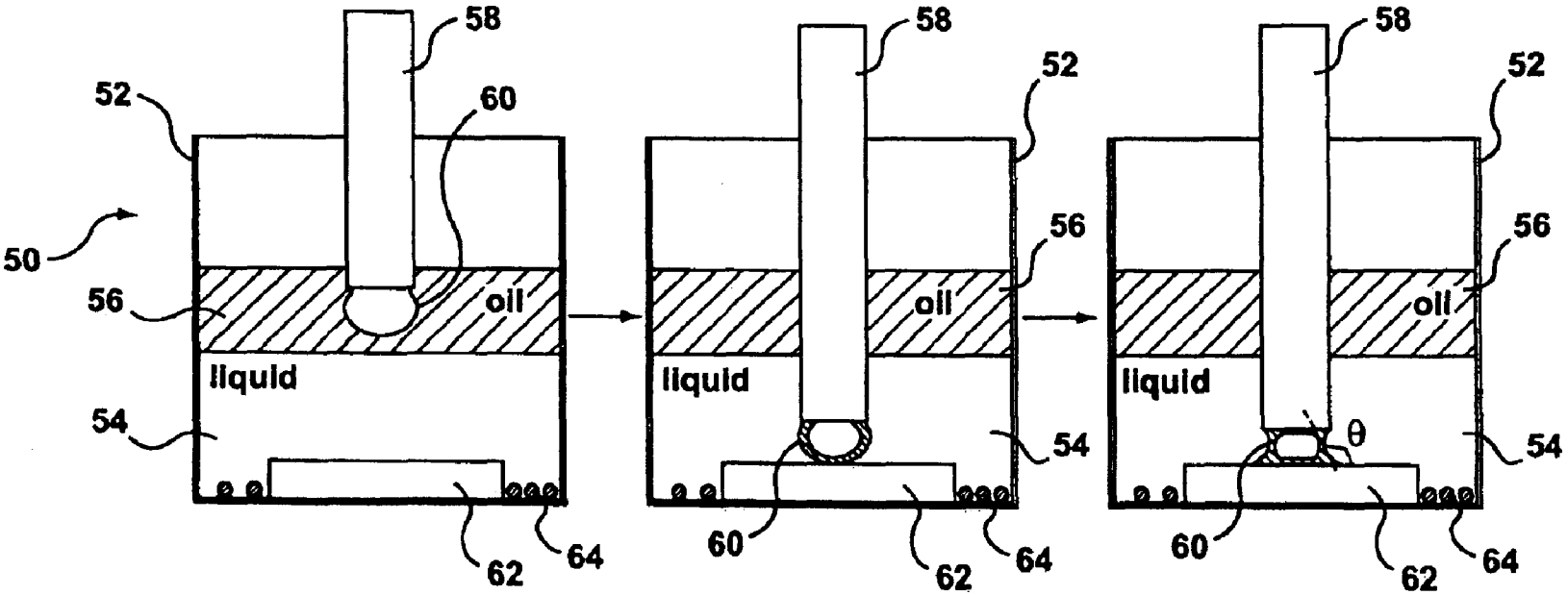
FIGS. 5*a,* 5*b* and 5*c* are a series of schematic diagrams illustrating the successive stages of operation of a contact angle measurement apparatus according to the present invention.

Now referring to FIGS. 5*a,* 5*b,* and 5*c,* a series of schematic diagrams are shown to illustrate the successive stages of operation of a contact angle measurement apparatus 50 according to the present invention. The apparatus 50 generally comprises a transparent vessel 52 containing an aqueous phase 54, and a layer of oil 56. The aqueous phase 54 may contain an activator and/or a depressant. The layer of oil 56 contains a collector (not shown) dissolved therein. The layer of oil 56 may also contain a frother. A micro syringe 58 (without a needle) is used to create a reactive oily bubble carrier 60 according to the present invention. A solid sample 62 is placed at the bottom of the vessel 52 as shown in FIG. 5*a*. A few drops of the prepared surfactant in oil solutions 64 were placed around the solid sample 62 to simulate the reactive oily bubble flotation environment.

A silica water was obtained by oxidizing the silicon wafer in a ventilated furnace at 1100° C. for about 2 hours. The oxidized wafer had a deep blue color. The sphalerite (zinc sulphide) and galena (lead sulphide) solid mineral crystal samples were obtained by fracturing a chunk of minerals, and carefully choosing the samples having flat fracture surfaces.

The method used to measure the contact angle of a reactive oily bubble carrier on a solid sample surface is described in detail below. The solid samples were first washed with ethanol to remove possible organic contaminants, and then rinsed thoroughly with deionized water before each measurement. Optionally, an activator and/or a depressant can be added to the aqueous phase. The aqueous phase 54 is added to the bottom of the vessel 52. Then, the cleaned samples were placed in the aqueous phase 54 located at the bottom of the transparent vessel 52. A given amount of collector, and optionally a frother, were dissolved in the layer of oil 56 (kerosene) to a desired concentration(s). A few drops of the prepared surfactant in oil solutions 64 were placed carefully around the solid samples in the aqueous phase 54, as shown in FIG. 5*a,* to simulate the reactive oily bubble flotation environment. A layer of the collector-containing oil 56 was gently placed on the top of the aqueous phase 54. A bubble 60 was created at the tip of a micro syringe 58 (without a needle), and held for approximately 5 minutes in the oil phase 56, as shown in FIG. 5*a*. This ensures that the bubble 60 is coated with a layer of oil containing collector dissolved therein. Next, FIG. 5*b* illustrates the reactive oily bubble carrier 60 being moved into in the aqueous phase 54 and held there for an additional 5 minutes, prior to making contact with the solid sample 62. Next, the reactive oily bubble carrier 60 is made to touch the surface of the solid sample 62. The advancing contact angle was measured directly from a video-assisted NRL goniometer (Rame-Hart, N.J.) through the aqueous phase at the moment when the reactive oily bubble was just about to detach from the solid surface of the sample via reducing the volume of the reactive oily bubble carrier 60, as shown in FIG. 5*c*. The measurement was performed on both sides of the reactive oily bubble carrier 60. A few positions on the sample were examined for each condition, and the average values were reported. The measurement errors were within 5 degrees.

Microflotation Tests

Figure 6:
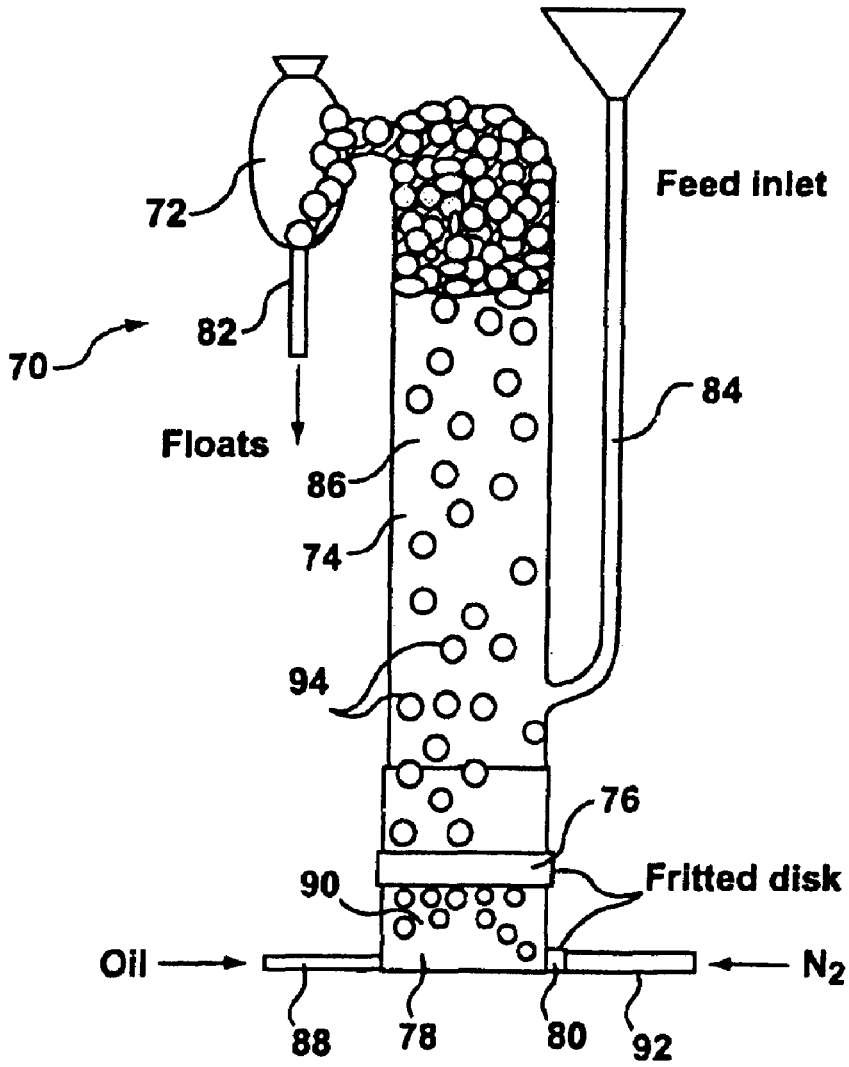
FIG. 6 is a schematic diagram of a modified microflotation cell apparatus according to the present invention.

Now referring to FIG. 6, a schematic diagram of a modified microflotation cell apparatus is shown generally at 70. Microflotation tests were conducted to demonstrate the feasibility of applying reactive oily-bubbles in flotation systems. The apparatus 70 generally comprises a froth-collecting lauder 72, a main body 74, a first fritted disk 76, a bottom chamber 78, and a second fritted disk 80, all of which are fluidly connected. The froth-collecting lauder 72 has an outlet 82 for removing the collected minerals (agglomerates) from the apparatus 70. The main body 74 has a feed inlet 84 for introducing an aqueous phase 86. The first fritted disk 76 is located between the main body 74 and the bottom chamber 78. The bottom chamber 78 has an oil feed inlet 88 for introducing an oil phase 90. The bottom chamber 78 also has a gas feed inlet 92, for introducing a compressed gas into the apparatus 70. The second fritted disk 80 is located in the gas inlet 92 passageway.

The method used to operate the modified microflotation cell apparatus 70 is described in detail below. Firstly, the aqueous phase 86 is introduced into the main body 74 through the feed inlet 84. The aqueous phase 74 comprises at least one particle species. The aqueous phase may also contain an activator and/or a depressant, if desired. Next, the oil phase 90 is introduced into the bottom chamber 78 through the oil feed inlet 88. The oil phase 90 comprises an oil and a collector dissolved therein. Preferably, the collector is a surfactant that is substantially soluble in oil and substantially insoluble in the aqueous phase. The oil phase 90 may also contain a frother if desired. The bottom chamber 78 is fully filled with the oil phase 90.

Preferably, a plurality of reactive oily bubbles 94 are generated by: (a) introducing the compressed gas (e.g., nitrogen or air) into the gas feed inlet 92 where it passes through the holes in the second fritted disk 80 to create a plurality of gas bubbles; (b) passing the plurality of gas bubbles through the oil phase 90; and (c) passing the plurality of gas bubbles through the holes in the first fritted disk 76 to introduce the gas bubbles into the aqueous phase thereby causing the formation of oil-coatings on the surfaces of the gas bubbles. A magnetic stir bar (not shown) is placed on the first fritted disk 76 to magnetically agitate the suspended particle species in the aqueous phase 74, and to provide breaks in the gas streams to form reactive oily bubbles 94 of desired sizes. Preferably, the diameters of the reactive oily bubbles range from about 100 microns to about 1 mm. Preferably, the reactive oily bubble carriers are floated in the aqueous phase under sufficient conditions to cause at least a portion of the target particles to contact at least a portion of the reactive oily bubble carriers thereby forming agglomerates. The mixing further enhances the collision efficiency of the reactive oily bubble carriers 94 with the targeted particles, increasing the rate of formation of the agglomerates. Preferably, the agglomerates float upwards towards the top of the apparatus 70. Preferably, the agglomerates overflow into the froth-collecting lauder 72, and may be separated from the apparatus 70 through the outlet 82. Optionally, the target particles may be recovered from the agglomerates through a separation process, such as, filtration.

After collecting the agglomerates from the froth collecting lauder 72 for a given period of time, both concentrate and tailings were filtered, dried, and weighed to evaluate recovery of the target particle species. For binary systems containing two different particle species, the grade was also evaluated for the target metal.

Example 1

Zeta Potentials

Figure 7:
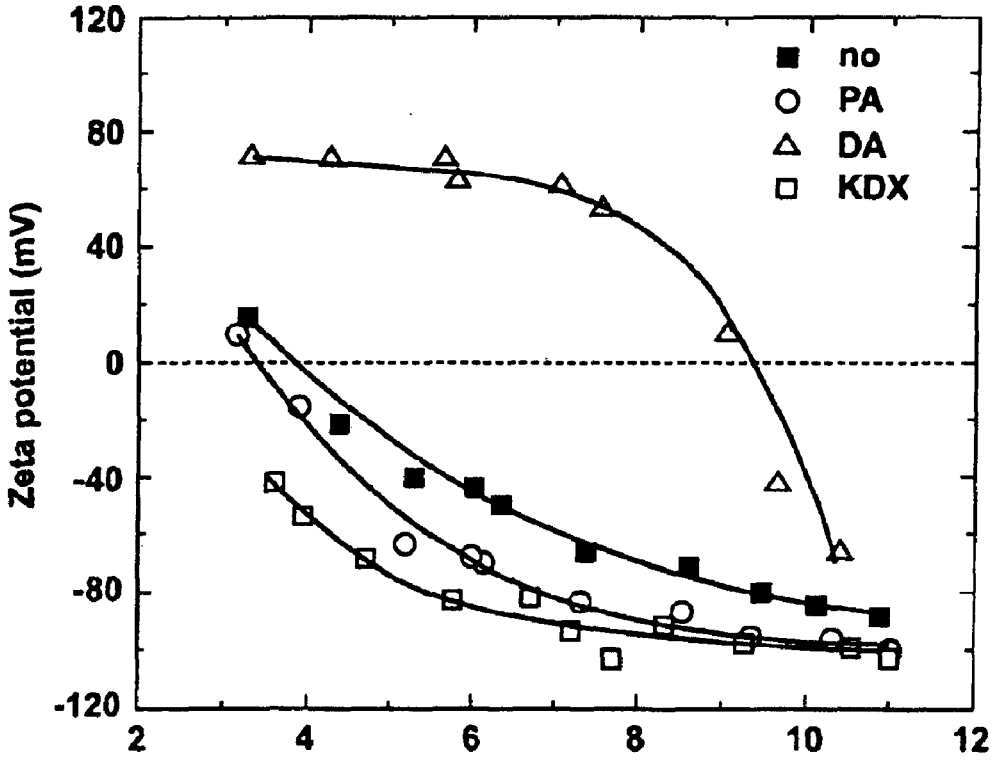
FIG. 7 is a graph of the zeta potentials of oil droplets in aqueous collector (surfactant) solutions as a function of pH.

Now referring to FIG. 7, a graph of the zeta potentials of oil droplets in different collector (surfactant) solutions as a function of pH is shown. As explained above, this system can be used as a substitute for reactive oily bubble carriers with collector dissolved therein. The results clearly show that the electrokinetics of the kerosene emulsion can be finely tuned for the desired functionality by changing the type and concentration of collectors.

In the absence of collector (surfactant) the kerosene emulsion exhibited an iso-electric point (iep) or 'zero charge' at a pH of approximately 4. This value was slightly higher than that for pure hydrocarbon oil droplets (Liu, et al., 2001), indicating a relatively complex nature of the kerosene.

In the presence of 0.01 mM NaPa, the zeta potentials of the kerosene emulsion became more negative, suggesting the adsorption of NaPa molecules at the kerosene/water interface. Since HPa is known to be a weak acid, it ionizes in water and the degree of ionization varies with pH over 4–6 (King, 1982; Laskowski, 1999; Laskowski, et al., 1988). At a pH<7, the carboxylic groups in HPa are predominantly in the neutral acid form. At pHs>7, the ionized species of HPa molecules adsorbed at the kerosene/water interface contributed to the increased surface charge density, resulting in a more negative zeta potential value by about 15 mV. Accordingly, the adsorption of NaPa only had a marginal effect on the zeta potential of kerosene oil droplets, mainly due to a weak acidic nature of carboxylic groups.

In 0.01 mM KDX solution, the zeta potentials of the kerosene emulsion became even more negative without an iep over the solution pH range tested.

In a 0.01 mM DACI solution, the zeta potentials of the kerosene emulsion became positively charged over a wide pH range with an iep at a pH of approximately 9.5. Similar observations were made by Laskowski et al (1988, 1999) for air bubbles in DACI solutions. It is known that DAH molecules are mostly protonated at pH<10 (King, 1982; Laskowski, 1999) with dominating species being positively charged amine groups. The observed zeta potential reversal of kerosene emulsions at pH below 9 in 0.01 mM DACI solution suggests the adsorption of cationic amine on the kerosene droplets. Accordingly, DACI can change the zeta potential of kerosene oil droplets from negative to positive with a significant shift of iso-electric point (iep). Although not illustrated in FIG. 7, the iep of the kerosene emulsion was found to vary with the DACI concentrations as anticipated.

Example 2

Contact Angle Measurements for Reactive Oily Bubble Carriers Without a Collector Tests were conducted to determine whether the potential migration of collector from the oil phase into the aqueous phase would negatively promote the attachment of non-target or unwanted particle species onto the surface of the reactive oily bubble carriers. To that end, collector-containing oil droplets were placed around the mineral sample as shown in FIGS. 5*a*–5*c* to simulate the reactive oily bubble environment where potential migration of collector into the aqueous phase might occur, and collector-free oily bubbles were formed and tested as described in detail above. All of the tests conducted for the different collectors contained in the oil droplets surrounding the mineral sample resulted in zero contact angles between the collector-free oily bubbles and the mineral samples, suggesting a zero flotation of the particles under such conditions. These findings demonstrate the minimal effect of collector migration into the aqueous phase, if any, on non-target or unwanted particle species in reactive oily bubble flotation systems.

Microflotation Measurements for Reactive Oily Bubble Carrier Without a Collector As a baseline test, microflotation was performed with collector-free oily bubbles. For all the minerals, a zero flotation recovery was obtained. Considering all the minerals examined in this study were not naturally hydrophobic, non-floatable results with collector-free oily bubbles were anticipated. This is in line with the results of attachment tests using oily bubbles without collector addition as reported in example 2.

Example 3

Figure 8:
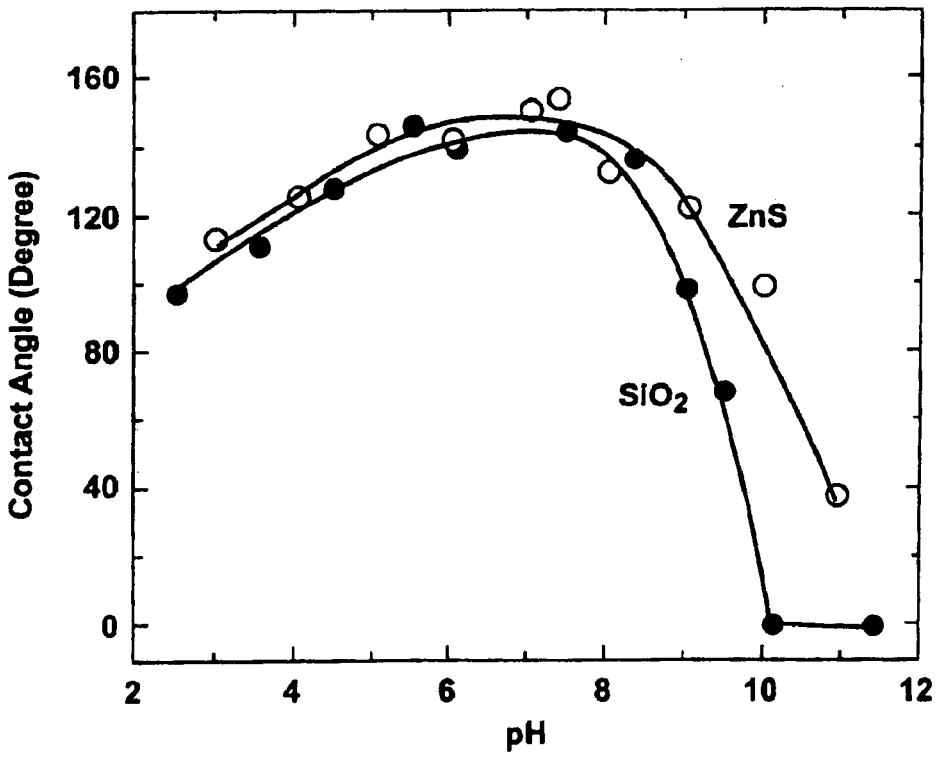
FIG. 8 is a graph of contact angles of reactive oily bubble carriers with 0.5 mM dodecylamine (DDA) dissolved therein on various mineral surfaces as a function of pH.

Contact Angle Measurements for Reactive Oily Bubble Carriers Containing DDA Collector Dissolved Therein Referring now to FIG. 8, a graph of contact angles of reactive oily bubble carriers with 0.5 mM dodecylamine (DDA) dissolved therein on various mineral surfaces as a function of pH is shown.

When 0.5 mM DDA was dissolved into the kerosene, the kerosene-covered oily bubble attached readily to silica wafer surfaces over a wide pH range up to 9. Contact angle values as high as 150° were obtained over a pH range of about 4 to about 9. It is evident that the addition of DDA made the kerosene-covered oily bubble responsive to silica attachment, and hence silica flotation is anticipated with reactive oily bubble carriers generated with DDA-containing kerosene. Since it has been established that kerosene droplets containing 0.5 mM DDA are positively charged up to pH 9.5, while silica has an iep of around 2, it appears that the electrostatic double layer interaction mechanism between positively charged DDA head groups at kerosene/water interface and negatively charged silica surfaces facilitates the adhesion of the kerosene droplets and subsequent adsorption of DDA on negatively charged silica surfaces, resulting in subsequent spreading of oily bubble on the silica surface. At a pH above 9.5, on the other hand, a significant decrease in contact angle value to zero is attributed to electrostatic repulsion between kerosene droplets and silica, both of which are negatively charged above this pH. It is interesting to note that the observed contact angle variation with aqueous solution pH in amine-containing oily bubble/water/silica system resembles closely to zeta potential variation of oil drop or air bubbles in amine solutions. However it is different from contact angles on silica surface measured with air bubbles on silica in amine aqueous solutions (Fuerstenau, et al., 1957).

It is interesting to note a similar variation with solution pH of contact angle values of the oily bubble on sphalerite (zinc sulphide) to that on silica. However, the iep for the sphalerite tested was observed at pH 7.5. Clearly, the observed strong adhesion at pH below 7.5 cannot be accounted for by the electrostatic double layer attraction. It appears that the chemical binding between the amine group on reactive oily bubble carrier and zinc sites on sphalerite is responsible for the observed adhesion. The attachment results presented here suggest that the separation of sphalerite from silica is unlikely successful by using DDA-containing kerosene oily bubbles.

Microflotation Measurements for Reactive Oily Bubble Carriers Containing DDA Collector Dissolved Therein Silica samples having particle sizes of less than 40 μm were purchased from the US Silica Company. Sphalerite crystals were hand picked, and then ground in a mortar to less than 75 μm. In each microflotation test, the pH of the de-ionized water was pre-adjusted to a desired value by the addition of HCl or NaOH as required. Then, a single mineral sample (e.g., silica or sphalerite alone) was mixed with the de-ionized water at the pre-adjusted pH. The resultant suspension was transferred into the microflotation cell through the feed inlet. Flotation occurred as the reactive oily bubbles emerged into the suspension.

Figure 9:
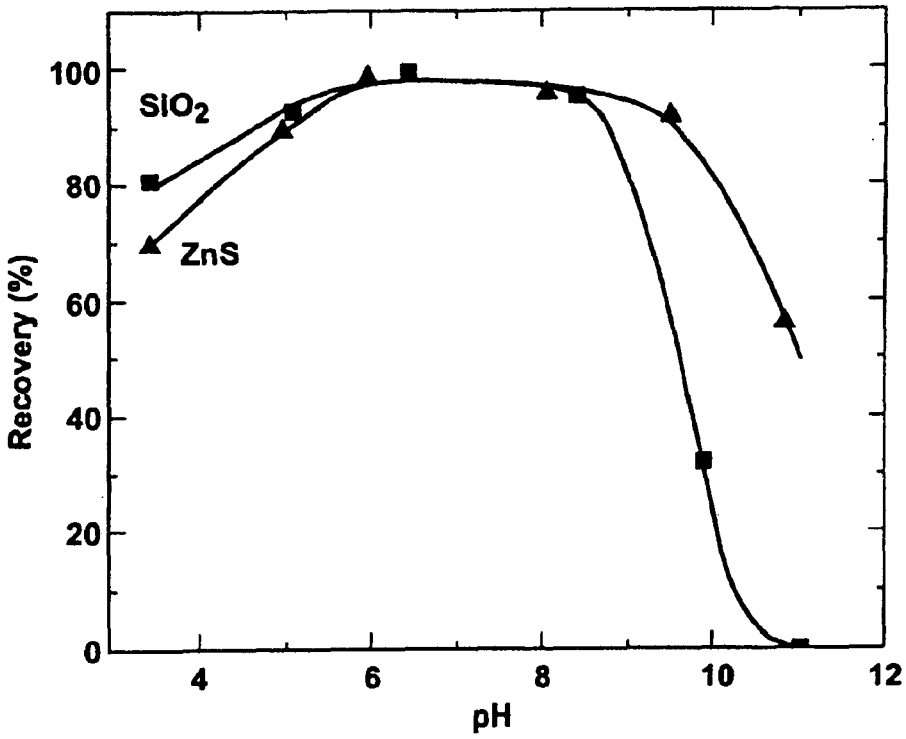
FIG. 9 is a graph of percent recoveries of silica ($SiO_2$) from a single mineral system and sphalerite (ZnS) from a single mineral system using reactive oily bubble carriers with 0.5 mM dodecylamine (DDA) dissolved therein as a function of pH.

Referring now to FIG. 9, a graph of percent recoveries of silica from a single mineral system and sphalerite from a single mineral system using reactive oily bubble carriers with 0.5 mM dodecylamine (DDA) dissolved therein as a function of pH are shown.

In flotation using DDA-containing oily bubbles, the percent recoveries of both silica and sphalerite increased with pH, reaching a maximum of >95% at a pH of between about 5 to 9. Above a pH of 9, the percent recoveries for both reduced, but more so for silica than sphalerite. At a pH 11, for example, the recovery of silica dropped to zero, while for sphalerite, it retained a limited recovery of 60%. The observed trend of recovery with pH is in excellent agreement with that of contact angle measurement as shown in FIG. 8. The flotation results confirmed an ineffective flotation separation of sphalerite from silica from a binary mineral system containing both sphalerite and silica using DAA-containing reactive oily bubble carriers, as predicted in contact angle measurements.

However, sphalerite can be effectively floated with DDA-containing reactive oily bubble carriers in a single mineral system containing only sphalerite between a pH of about 5 to about 9. Similarly, silica can be effectively floated with DDA containing reactive oily bubble carriers in a single mineral system containing only silica between a pH of about 5 to about 9.

Example 4

Figure 10:
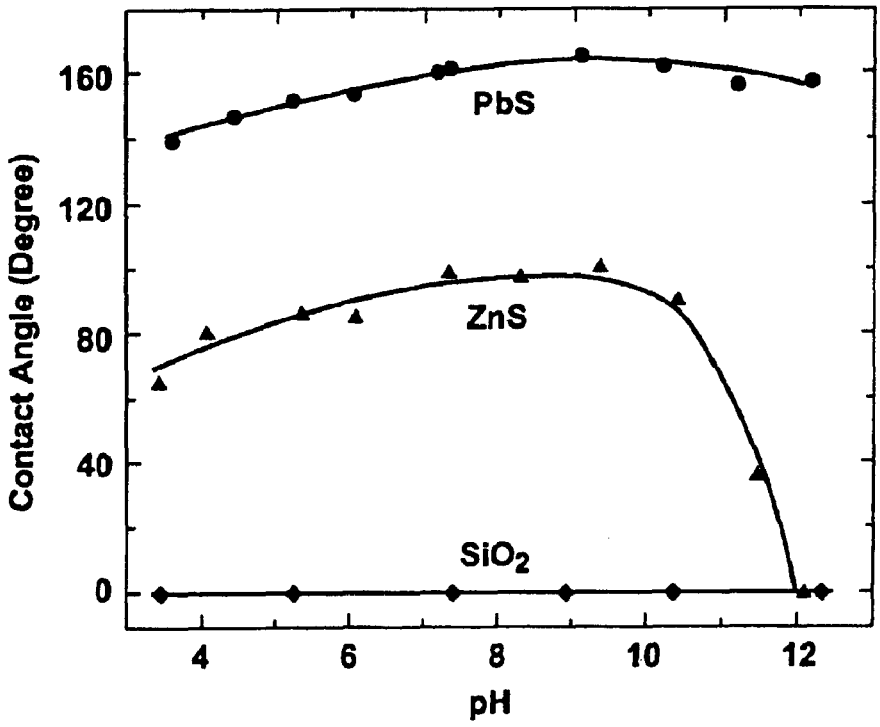
FIG. 10 is a graph of contact angles of reactive oily bubble carriers with 0.05 mM potassium dodecyl xanthate (KDX) and 0.25 v/v % MIBC dissolved therein on various mineral surfaces as a function of pH.

Contact Angle Measurements for Reactive Oily Bubble Carriers Containing KDX Collector and MIBC Frother Dissolved Therein Referring now to FIG. 10, a graph of contact angles of reactive oily bubble carriers with 0.05 mM potassium dodecyl xanthate (KDX) and 0.25 v/v % MIBC dissolved therein on various mineral surfaces as a function of pH is shown.

Over the pH range studied, KDX containing reactive oily bubble carriers cannot be press-attached to silica surfaces, as indicated by zero contact angle values.

For sphalerite, a contact angle value of 80° was obtained over a pH range from about 5 to about 10. This relatively high contact angle appears to be related to the reactivity of the xanthate on spalerite. At a pH of about 12, the contact angle for sphalerite is about 0°.

For galena, a contact angle as high as 160° was obtained with KDX containing reactive oily bubble carriers over the entire pH range studied. With such a high contact angle value, a strong collecting power of galena by reactive oily bubble carriers is anticipated.

Microflotation Measurements for Reactive Oily Bubble Carriers Containing KDX Collector and MIBC Frother Dissolved Therein to Determine the Recoveries of PbS and Grades of Pb from a Binary Mineral System of $PbS/SiO_2$ Silica samples were purchased from the US Silica Company. Hand-picked sulphide mineral crystals of sphalerite crystals (65.33% Zn) and galena (84.63% Pb) were ground in a mortar. The particle sizes for silica, spharelite, and galena were approximately 11 μm, 17 μm and 10 μm, respectively.

In each microflotation test, a binary mineral sample of PbS and $SiO_2$ in a ratio of 1:4 was prepared by mixing 5 grams of the mineral mixture with about 120 mL of deionized water for about 3 to 5 minutes. Next, the pH was adjusted to a desired value by adding HCl or NaOH as required. The resultant suspension was transferred into the microflotation cell through the feed inlet. Flotation occurred as the reactive oily bubbles emerged into the suspension.

Figure 11:
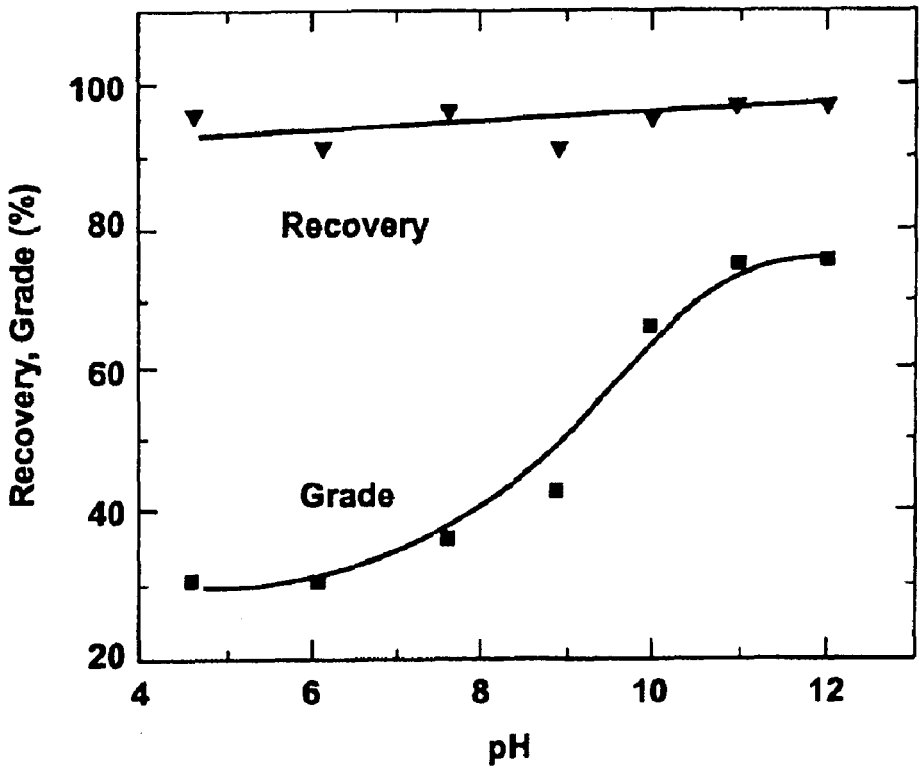
FIG. 11 is a graph of percent recoveries of galena (PbS) and percent grades of lead ($Pb^{2+}$) from a binary mineral system of $PbS/SiO_2$ using reactive oily bubble carriers with 0.5 mM potassium dodecyl xanthate (KDX) and 0.25 v/v % MIBC dissolved therein as a function of pH.

Referring now to FIG. 11, a graph of percent recoveries of PbS and percent grades of Pb from a binary mineral system of $PbS/SiO_2$ using reactive oily bubble carriers with 0.5 mM potassium dodecyl xanthate (KDX) and 0.25 v/v % MIBC dissolved therein as a function of pH are shown.

PbS can be preferentially floated from the $PbS/SiO_2$ binary mineral system at a pH between about 11 to about 12 with a recovery of PbS at around 98% and a grade of Pb at around 78%. At pH<10 the PbS recovery remained higher than 95%, but the grade of Pb decreased significantly. The decrease in concentrate grade can be attributed to either the hetero-coagulation between PbS and $SiO_2$ or activated flotation of silica from $Pb^{2+}$ ions released by PbS.

Microflotation Measurements for Reactive Oily Bubble Carriers Containing KDX Collector and MIBC Frother Dissolved Therein to Determine the Recoveries of PbS and Grades of Pb from a Binary Mineral System of PbS/ZnS In each microflotation test, a binary mineral sample of PbS and ZnS in a ratio of 1:1 was prepared by mixing 5 grams of the mineral mixture with about 120 mL of deionized water for about 3 to 5 minutes. Next, the pH was adjusted to a desired value by adding HCl or NaOH as required. The resultant suspension was transferred into the microflotation cell through the feed inlet. Flotation occurred as the reactive oily bubbles emerged into the suspension.

Figure 12:
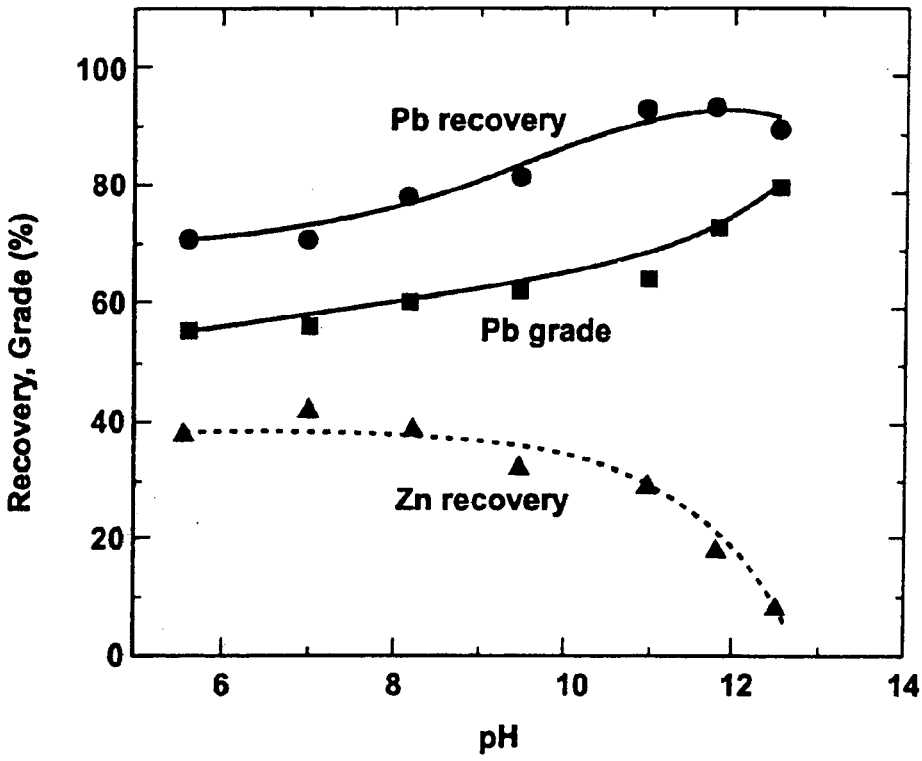
FIG. 12 is a graph of percent recoveries of galena (PbS) and percent grades of ($Pb^{2+}$) from a binary mineral system of PbS/ZnS using reactive oily bubble carriers with 0.5 mM potassium dodecyl xanthate (KDX) and 0.25 v/v % MIBC dissolved therein as a function of pH.

Referring now to FIG. 12, a graph of percent recoveries of PbS and percent grades of Pb from a binary mineral system of PbS/ZnS using reactive oily bubble carriers with 0.5 mM potassium dodecyl xanthate (KDX) and 0.25 v/v % MIBC dissolved therein as a function of pH is shown.

PbS can be preferentially floated from the PbS/ZnS binary mineral system at a pH between about 12 to about 12.5 with a recovery of PbS between about 90–92% and a grade of Pb between about 75–80%. At pH<11 the PbS recovery decreased, and the grade of Pb also decreased significantly. The decrease in concentrate grade can be attributed to either the hetero-coagulation between PbS and ZnS or activated flotation of ZnS by $Pb^{2+}$ ions released from PbS.

Example 5

Figure 13:
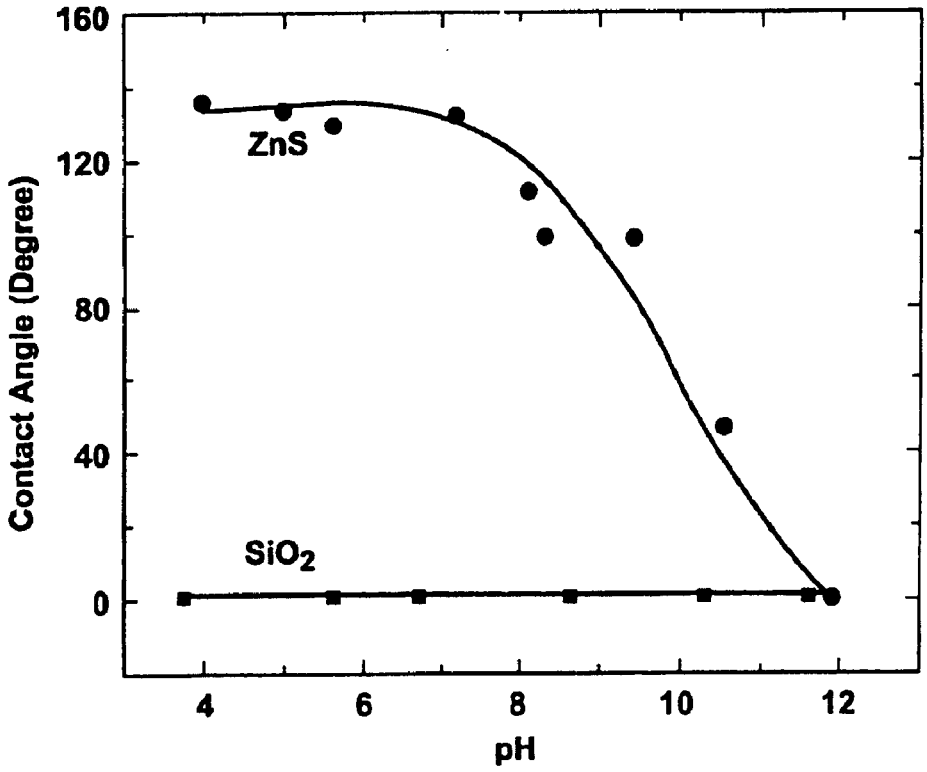
FIG. 13 is a graph of contact angles of reactive oily bubble carriers with 0.05 mM potassium dodecyl xanthate (KDX)

Contact Angle Measurements for Reactive Oily Bubble Carriers Containing KDX Collector and MIBC Frother Dissolved Therein and $Na_2SiO_3$ Depressant and $CuSO_4$ Activator Dissolved in the Aqueous Phase Referring now to FIG. 13, a graph of contact angles of reactive oily bubble carriers with 0.05 mM potassium dodecyl xanthate (KDX) and 0.25 v/v % MIBC dissolved therein on various mineral surfaces as a function of pH is shown with the addition of 2 mM $Na_2SiO_3$ and 0.5 mM $CuSO_4$ into the aqueous phase.

The addition of 2 mM $Na_2SiO_3$ effectively depressed the $SiO_2$ activation to a zero contact angle over the entire pH range studied.

The addition of 0.5 mM $CuSO_4$ effectively activated the ZnS to achieve contact angle values of between about 80° to about 125° over a pH range from about 4 to about 9 and $Na_2SiO_3$ addition showed little effect.

Microflotation Measurements for Reactive Oily Bubble Carriers Containing KDX Collector and MIBC Frother Dissolved Therein and $Na_2SiO_3$ Depressant and $CuSO_4$ Activator Dissolved in the Aqueous Phase to Determine the Recoveries of ZnS and Grades of Zn from a Binary Mineral System of $ZnS/SiO_2$ In each microflotation test, a binary mineral sample of ZnS and $SiO_2$ in a ratio of 1:4 was prepared by mixing 5 grams of the mineral mixture with about 120 mL of deionized water for about 3 to 5 minutes. Next, the pH was adjusted to a desired value by adding HCl or NaOH as required. The resultant suspension was transferred into the microflotation cell through the feed inlet. Flotation occurred as the reactive oily bubbles emerged into the suspension.

Figure 14:
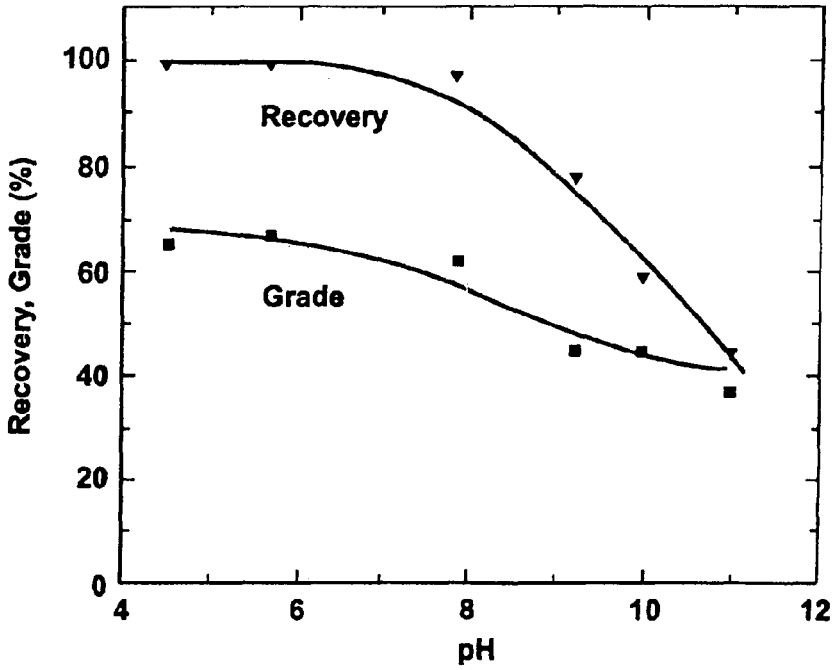
FIG. 14 is a graph of percent recoveries of ZnS and percent grades of Zn from a binary mineral system of $ZnS/SiO_2$ using reactive oily bubble carriers with 0.5 mM potassium dodecyl xanthate (KDX) and 0.25 v/v % MIBC dissolved therein as a function of pH with the addition of 2 mM $Na_2SiO3$ and 0.5 mM $CuSO_4$ into the aqueous phase.

Referring now to FIG. 14, a graph of percent recoveries of ZnS and percent grades of Zn from a binary mineral system of $ZnS/SiO_2$ using reactive oily bubble carriers with 0.5 mM potassium dodecyl xanthate (KDX) and 0.25 v/v % MIBC dissolved therein as a function of pH are shown with the addition of 2 mM $Na_2SiO_3$ and 0.5 mM $CuSO_4$ into the aqueous phase.

ZnS can be preferentially floated from the $ZnS/SiO_2$ binary mineral system at a pH<8 with a recovery of ZnS between about 95–99% and a grade of Zn of about 64%. At pH >8, both ZnS recovery and Zn grade decreased sharply due to depression of ZnS at higher pH as anticipated from the measured contact angles shown in FIG. 13 above.

Example 6

Comparison of Conventional Air Bubble Flotation Containing KDX Collector Dissolved in the Aqueous Phase and Reactive Oily Bubble Carriers Containing KDX Collector Dissolved Therein Assuming the batch flotation process follows a first order process, flotation recovery (R) as a function of flotation time (t) is well described by the following recovery rate equation:

$$R=R_M(1-e^{-\kappa(t-\tau)}) \quad [1]$$

where $R_M$ is the ultimate flotation recovery, κ is the flotation rate constant, and τ is the time delay related to the flotation test itself. The collected flotation recovery data can be used to estimate the $R_M$ and κ values, which allows a good overall assessment of flotation performance. The flotation kinetic parameters, (e.g., flotation rate constant (κ) and ultimate recovery ($R_M$)), obtained with single mineral systems using conventional air bubbles and reactive oily bubble carriers were summarized in Table 1 below.

For ZnS flotation, 2 mM of $Na_2SiO_3$ depressant and 0.5 mM of $CuSO_4$ activator were added to the aqueous phase in both the conventional air bubble flotation and the reactive oily bubble carrier flotation.

| Rate parameter | Reactive oily bubble (collector dissolved in oil phase) | Conventional (collector dissolved in aqueous phase) | | |
|---|---|---|---|---|
| KDX (mM) | 0.05 mM* | 0.001 mM | 0.005 mM | 0.05 mM |
| | | Sphalerite (ZnS) | | |
| $R_M$ (%) | 99 | 28 | 86 | 96 |
| k ($min^{-1}$) | 0.75 | 0.5 | 0.5 | 0.6 |
| | | Galena (PbS) | | |
| $R_M$ (%) | 99 | 63 | 84 | 99 |
| k ($min^{-1}$) | 1.25 | 0.5 | 0.75 | 1.25 |

*this is equivalent to 0.001 mM of collector in the aqueous phase for conventional air bubble flotation process.

When comparing the reactive oily bubble carrier flotation with 0.05 mM KDX dissolved in the oil phase and the conventional air bubble flotation with 0.05 mM KDX dissolved in the aqueous phase, the results are comparable as shown in Table 1. However, since the oil phase in the reactive oily bubble carrier flotation only accounts for about 2–3% of the total slurry volume, the absolute mass of collector in the reactive oily bubble carrier flotation is much smaller than what is required in conventional air bubble flotation. Moreover, when an equal mass of collector is added to the oil phase in the reactive oily bubble carrier flotation (i.e., to produce a concentration of 0.05 mM KDX in the oil phase) and to the aqueous phase in the conventional air bubble flotation (i.e., to produce a concentration of 0.001 mM KDX in the aqueous phase), the reduction in the ultimate recoveries of the target particle species is dramatically reduced for the conventional air bubble flotation process. Specifically, the ZnS recoveries for reactive oily bubble carrier flotation processes and conventional air bubble flotation processes are 99% and 28%, respectively. Similarly, PbS recoveries for reactive oily bubble carrier flotation processes and conventional air bubble flotation processes are 99% and 63%, respectively.

The reactive oily bubble carrier flotation process results in a much higher contact angle value than that attainable by conventional air bubble flotation processes. A stronger collecting power for both fine and coarse particles is achieved.

Having illustrated and described the principles of the invention in a preferred embodiment, it should be appreciated to those skilled in the art that the invention can be modified in arrangement and detail without departure from such principles. We claim all modifications coming within the scope of the following claims.

All publications, patents and patent applications referred to herein are incorporated by reference in their entirety to the same extent as if each publication, patent or patent application was specifically and individually indicated to be incorporated by reference in its entirety.

References Cited in Application

Fuerstenau, D. W., Metzger, P. H. and Steele, G. D., How to Use This Modified Hallimond Tube, *Eng. Min. J.*, 1957, 158, 93.

Kusaka, E., Nakahiro, Y., Wakamatsu,T., The Role of Zeta-Potentials of Oil Droplets and Quartz Particles during Collectorless Liquid—Liquid Extraction, *International Journal of Mineral Processing,* 1994, 41, 257–269.

Laskowski, J. S., Weak Electrolyte Collectors, in *Advances in Flotation Technology,* eds. B. K. Parekh, and J. D. Miller, The TSM Inc., Colorado, USA, 1999, 58–82.

Laskowski, J. S., Vurdela, R. M., and Liu, Q., The Colloid Chemistry of Weak Electrolyte Type collector flotation, in *Proceedings of XVI International Mineral Processing Congress,* ed. K. S. E. Forssberg, 1988, Elseiver Science Publishers, New York, N.Y., USA, 703–715

Yoon, R. H., Microbubble Flotation, *Minerals Engineering,* 1993, 6(6), 619–630.

Fuerstenau, D. W., "Fine Particle Flotation" in: *Fine Particle Processing,* P. Somasundaran, Eds., The society of AIME, New York, N.Y., USA, 1980, pp.669–705.

Kent, W. and Ralston, J., "Polymer-stabilized emulsions and fine-particle recovery, II. the chalcopyrite-quartz system", *Int. J. Miner. Process,* Vol.14, pp.217–232, 1985.

King, R. P., Eds., *Principles of Flotation,* South Africa Institute of Mining and Metallurgy, Johannesburg, 1982.

Kusaka, E., Nakahiro, Y., Wakamatsu,T., "The role of zeta-potentials of oil droplets and quartz particles during collectorless liquid—liquid-extraction", *Int. J. Miner. Process,* Vol. 41, pp.257–269, 1994.

Kusaka, E., Kamata, Y., Fukunaka, Y., Nakahiro, Y., "The role of hydrolyzed metal cations in the liquid—liquid extraction of ultrafine silica with dodecyl sulfate", *Miner. Eng.,* Vol. 10, pp. 155–162, 1997.

Laskowski, J. S., "Oil assisted fine particle processing" in: *Colloid Chemistry in Mineral Processing,* Laskowski, J. S. and Ralston, J., Eds., Elsevier Science Publishers,New York, N.Y., USA, pp.361–394, 1992.

Liu, J., Zhou, Z. and Xu, Z., "Electrokinetic study of hexane droplets in surfactant aqueous solutions", presented at $39^{th}$ Conference of Metallurgists, hold on Aug. 26–29, 2001, in Toronto, Ontario.

Liu, J., Zhou, Z., Xu, Z. and Masilyah, J., "Interactions between clays and bitumen in aqueous media from the measurement of zeta potential distributions", *J. Colloid Interf. Sci.,* Vol.252, pp.409–418, 2002.

*Mineral Processing Handbook,* (SME Inc., Littleton Colo., 1985)

Ralston, J., Kent, W. and Newcombe, G., "Polyer-stabilized emulsions and fine-particle recovery, I. The Calcite-quartz system", *Int. J. Miner. Process,* Vol.13, pp.167–186, 1984.

Ralph, W., Lai, M. and Fuerstenau, D. W., "Liquid—liquid extraction of ultrafine particles", *Transactions of AIME,* Vol. 241, pp.44–55, 1968.

Shen, M. and Wheelock, T. D., "Coal agglomeration with microbubbles", *Coal Preparation,* Vol.21, pp.277–298, 2000.

Shen, M. and Wheelock, T. D., "Development and scale-up of a gas-promoted oil agglomeration process for coal beneficiation", *Miner. Met. Proc.* Vol.18, pp.87–94, 2001.

Sivamohan, R., "The problem of recovering very line particles in mineral processing: A review", *Int. J. Miner. Process,* Vol.28, pp.247–288, 1990.

Somasundaran, P. and Arbiter, N. (Editors), *Beneficiation of Mineral Fines,* AIME, 1979, New York, N.Y.

Taggart, A. F., In: *Handbook of Ore Dressing,* John Wiley & Sons, New York, pp.945, 1927.

Wills, Barry, *Mineral Processing Technology,* $6^{th}$ ed, (Butterworths 1998)

Zambrana, G. Z., Medina, R. T., Gutierrez, G. B. and Vargas, R. R., "Recovery of minus ten micron cassiterite by liquid-liquid extraction", *Int. J. Miner. Process,* Vol.1, pp.335–345, 1974.

Xu, M., Quinn, P. and Stratton-Crawly, R., "A feed-line aerated flotation column. Part I: batch and continuous testwork", *Miner. Eng.,* Vol.9, 499–508, 1996.

Zhou, Z., Hussein, H., Xu, Z., Czamecki, J. and Masliyah, J. H., "Interaction of ionic species and fine solids with low energy hydrophobic surface from contact Angle measurement", *J. Colloid Interf. Sci.,* Vol.204, pp.342–349, 1998.

Zhou, Z., Hu, H., Xu, Z., Finch., J. A. and Rao, S. R., "Role of hydrodynamic cavitation in fine particle flotation", *Int. J. Miner. Process.* Vol.51, pp.139–149, 1997.

What is claimed is:

1. A flotation process for separation of one or more types of target particles in an aqueous phase comprising:

(a) introducing a gas stream through an oil to form a plurality of gas bubbles, wherein one or more collectors having an affinity for the one or more types of target particles are dissolved in said oil;

(b) introducing an amount of said gas stream through the oil into an aqueous phase comprising the one or more target particles, whereby an oil coating comprising the one or more collectors is formed on surfaces of gas bubbles to form oily bubbles and wherein the amount of oily bubbles is sufficient to promote attachment of the one or more types of target particles to the bubbles to form agglomerates that are separate or separated from the aqueous phase; and (c) optionally recovering said agglomerates.

2. The process of claim 1, wherein the one or more collectors in the oil-coating are in a concentration sufficient to enhance the affinity between the one or more types of target particles and the bubbles thereby promoting attachment of the one or more types of target particles to the oil-coating.

3. The process according to claim 1, wherein the oil and the oil coating further comprise a frother substantially dissolved therein.

4. The process according to claim 1, wherein the oil is substantially insoluble in the aqueous phase.

5. The process according to claim 1, wherein the collector is a surfactant.

6. The process according to claim 1, wherein the collector has a partition co-efficient that is higher in the oil-coating than in the aqueous phase.

7. The process according to claim 1, wherein the collector is substantially soluble in the oil-coating and substantially insoluble in the aqueous phase.

8. The process according to claim 1, wherein the aqueous phase further comprises one or more activators.

9. The process according to claim 1, wherein the aqueous phase further comprises one or more depressants.

10. The process according to claim 1, wherein the gas is air or nitrogen.

11. The process according to claim 1, wherein one collector having an affinity for one target particle is dissolved in said oil.

12. The process according to claim 1, wherein the one or more collectors promotes the selective attachment of the one or more types of target particles to the oily bubbles.

13. The process according to claim 1, wherein the gas stream is introduced from the oil into the aqueous phase through a fritted material.

14. The process according to claim 1, wherein the oily bubbles are floated in the aqueous phase under conditions sufficient to cause at least a portion of the target particles to contact at least a portion of the oily bubbles thereby forming the agglomerates.

15. The process according to claim 1, wherein the agglomerates float to the top of the aqueous phase.

16. The process according to claim 15, wherein the agglomerates are separated by overflowing into a separate container.

17. The process according to claim 1, wherein the oily bubbles are introduced into the aqueous phase with agitation of the aqueous phase.

18. The process according to claim 17, where said agitation is sufficient to promote agitation of the one or more particles, formation of gas bubbles of desired sizes and to enhance the collision frequency of the oily bubbles with the target particles.

19. The process according to claim 18, wherein the desired size of the gas bubbles is in the range of about 100 microns to about 1 mm.

20. The process according to claim 1, wherein the aqueous phase further comprises one or more frothers.

21. A flotation separation system comprising:

(a) a main body comprising a means for introducing an aqueous phase into said body, said aqueous phase comprising one or more target particles;

(b) a source of an oil phase containing oil and one or more collectors dissolved in said oil and having an affinity for said one or more types of target particles and a bottom chamber fluidly connected to said main body, said chamber comprising a means for introducing said, and a means for introducing a gas stream into said chamber to form bubbles in said oil phase, wherein said stream enters into the aqueous phase whereby an oil coating comprising the one or more collectors is formed on surfaces of gas bubbles to form oily bubbles in the aqueous phase; and (c) optionally, a means for separating and/or recovering material from said aqueous phase.

22. The system according to claim 21, wherein said chamber is separated from said main body by fritted material, and wherein said stream passes through said fritted material from the oil phase into the aqueous phase whereby an oil coating comprising the one or more collectors is formed on surfaces of gas bubbles to form oily bubbles in the aqueous phase.

23. The system according to claim 21, further comprising means to agitate said aqueous phase to promote agitation of the one or more particles, formation of gas bubbles of desired sizes and to enhance the collision frequency of the oily bubbles with the one or more types of target particles thereby forming agglomerates comprising the oily bubbles and the one or more target particles.

24. The system according to claim 23, wherein the material separated and/or recovered from said aqueous phase is the agglomerates.

* * * * *